US010662634B2

(12) United States Patent
Kashirajima et al.

(10) Patent No.: US 10,662,634 B2
(45) Date of Patent: May 26, 2020

(54) FLUSH TOILET

(71) Applicant: TOTO LTD., Kitakyushu-shi, Fukuoka (JP)

(72) Inventors: Shu Kashirajima, Kitakyushu (JP); Masaki Kitamura, Kitakyushu (JP); Satoshi Yamakawa, Kitakyushu (JP); Kazuyoshi Mizoguchi, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 15/427,487

(22) Filed: Feb. 8, 2017

(65) Prior Publication Data

US 2017/0226725 A1 Aug. 10, 2017

(30) Foreign Application Priority Data

Feb. 9, 2016 (JP) ..... 2016-022802

(51) Int. Cl.
*E03D 11/06* (2006.01)
*E03D 3/00* (2006.01)

(52) U.S. Cl.
CPC ..... *E03D 11/06* (2013.01); *E03D 3/00* (2013.01); *E03D 2201/30* (2013.01)

(58) Field of Classification Search
USPC ..... 4/420, 425
See application file for complete search history.

(56) References Cited

U.S. PATENT DOCUMENTS

| | | | | |
|---|---|---|---|---|
| 7,661,153 | B2 * | 2/2010 | Nakamura | E03D 11/08 4/420 |
| 2013/0047328 | A1 | 2/2013 | Yamasaki et al. | |
| 2015/0275494 | A1 * | 10/2015 | Kashirajima | E03D 11/02 4/420 |
| 2016/0138255 | A1 * | 5/2016 | Kitamura | E03D 11/08 4/420 |

FOREIGN PATENT DOCUMENTS

| | | | |
|---|---|---|---|
| CN | 102953421 | A | 3/2013 |
| JP | 2002097702 | A2 | 4/2002 |
| JP | 2007291643 | A | 11/2007 |
| JP | 2010138693 | A | 6/2010 |

* cited by examiner

*Primary Examiner* — Lauren A Crane
(74) *Attorney, Agent, or Firm* — Brooks Kushman P. C.

(57) ABSTRACT

The bowl portion of the flush toilet includes a bowl-shaped waste receiving surface and a rim portion formed on a top edge of the bowl portion. The rim portion includes a rim inside wall portion located on an inner side of the top edge of the bowl portion. The rim inside wall portion has a rim inside surface located at a lower area of the rim inside wall portion and a rim inside wall upper sloped surface having a section in a vertical plane, the shape of the section being sloped from an upper edge of the rim inside surface to an upper edge of the rim inside wall portion. The ratio between the height of the rim inside surface and the height of the rim inside wall upper sloped surface is 1:1 to 6:1 in a section in a vertical plane at any area other than a rear area.

5 Claims, 8 Drawing Sheets

FLUSH TOILET

CROSS-REFERENCE TO RELATED APPLICATIONS

This application claims priority to JP application JP 2016-022802 filed on, Feb. 9, 2016, the disclosures of which are incorporated in their entirety by reference herein.

TECHNICAL FIELD

The present invention pertains to a flush toilet, and more particularly to a flush toilet for flushing the toilet main unit with flush water supplied from a flush water source to discharge waste.

BACKGROUND

Conventionally, as set forth in JP-A-2013-44178, flush toilets have been known wherein in a wash-down type of flush toilet wherein a gravity fed storage tank is disposed as a water supply apparatus at the rear top portion of a flush toilet, the inside perimeter surface of the rim portion is formed to rise in an essentially plumb direction, and flush water is spouted from a rim spout port formed in the front region, to perform a flush as it circulates over the interior of the bowl portion.

SUMMARY

Technical Problem

Such flush toilets presented a concern that in cases where a gravity fed storage tank is not used but a direct pressure-type of water supply apparatus is applied in which a direct connection is made to a utility water supply or the like supplying water using the utility water pressure, flush water with an instantaneously high flow rate pressurized by the direct pressure of the utility could be spouted from the rim spout port, surpassing the inside perimeter surface of the rim portion formed to rise in an essentially vertical direction so as to splash outside the toilet. Thus, in the past, when seeking to form the inside perimeter surface of the rim portion in an essentially vertical direction, only gravity fed storage tanks were used because they are not affected by water pressure fluctuations.

In order to cope with the above problems, investigations have been made into constraining the splashing of water outside the toilet beyond the inside perimeter surface of the rim portion even when flush water at a relatively high flow rate is spouted from the rim spout port, by forming an overhang shape such that a top portion of the inside perimeter surface of the rim portion overhangs inwardly.

On the other hand, with respect to the rim portion of the toilet main unit, investigations have been conducted into flush toilets with improved easiness of the user's cleaning operation for the rim portion, by significantly rounding the corner of the inside perimeter surface of the rim top portion, making it easily cleaned by a user.

Also, investigations have been conducted into flush toilets in which, by forming the toilet main unit rim portion so that the corner on the inside perimeter surface of the rim top portion is significantly rounded, the user perceives that the top portion of the waste receiving surface widens outward, thereby showing the bowl portion to be relatively large compared to another conventional bowl portion, and imparting a sense of confidence regarding the ease with which a user can discharge urine into the bowl portion.

However, when seeking to adopt such high cleaning easiness of the rim portion, that is, when seeking to substantially round the corner on the inside perimeter surface of the rim top portion, the height of the inside perimeter surface of the rim portion is likely to be lowered. Thus, when the rim portion is not formed into an overhanging shape, and the flush water spouted from the rim spout port has a relatively high instantaneous flow rate, water can easily exceed the inside perimeter surface of the rim portion and splash outside the toilet. When a direct pressure-type of water supply apparatus is adopted for a flush toilet having a rim portion with high cleaning easiness, the problem is still further manifested because the flush water spouted from the rim spout port is likely to have a higher instantaneous flow rate.

The present invention therefore has the object of providing a flush toilet wherein the flush toilet comprises a rim inside wall upper sloped surface whose inside slopes downward, so that an improved visibility is achieved, i.e., the user can perceive that the top portion of the waste receiving surface widens outward, as well as an improved cleaning easiness is achieved, and wherein flush water can be constrained from splashing outside the bowl portion by traveling under centrifugal force along the rim inside wall upper sloped surface.

Solution to Problem

The present invention is a flush toilet including: a bowl portion including a bowl-shaped waste receiving surface and a rim portion formed on a top edge of the bowl portion; a spout portion provided in the bowl portion for generating a circulating current by spouting flush water to the bowl portion; a water conduit for supplying flush water to the spout portion; and a discharge path connected at a bottom part of the bowl portion; wherein the rim portion includes a rim inside wall portion located on an inner side of the top edge of the bowl portion; the rim inside wall portion has: a rim inside surface located at a lower area of the rim inside wall portion and having a section in a vertical plane, the shape of the section being linear or inwardly concave, and a rim inside wall upper sloped surface having a section in a vertical plane, the shape of the section being sloped from an upper edge of the rim inside surface to an upper edge of the rim inside wall portion; and a ratio between the height of the rim inside surface and the height of the rim inside wall upper sloped surface is within a range of 1:1 to 6:1 in a section in a vertical plane at any area other than a rear area.

According to the above feature, since the rim inside wall upper sloped surface has a section in a vertical plane, the shape of the section being sloped from the upper edge of the rim inside surface to the upper edge of the rim inside wall portion, an improved visibility is achieved, i.e., the user can perceive that the top portion of the waste receiving surface widens outward, as well as an improved cleaning easiness is achieved. In addition, since the ratio between the height of the rim inside surface and the height of the rim inside wall upper sloped surface is within a range of 1:1 to 6:1 in a section in a vertical plane at any area other than a rear area, it is possible to prevent the flush water from splashing outside the bowl portion beyond the rim inside wall upper sloped surface by a centrifugal force. Furthermore, since the ratio between the height of the rim inside surface and the height of the rim inside wall upper sloped surface is within a range of 1:1 to 6:1, it is possible to effectively prevent the discharged urine from rising up along the rim inside wall upper sloped surface and splashing outside the bowl portion beyond the rim inside wall upper sloped surface.

For example, it is preferable that the section in a vertical plane of the rim inside wall upper sloped surface has an arc shape. Such a rim inside wall upper sloped surface can be formed relatively simply. Such a rim inside wall upper sloped surface is also convenient for the user to keep clean by wiping. As a suitable size, for example, the arc shape of the section in a vertical plane of the rim inside wall upper sloped surface may have a curvature radius within a range of 10 mm to 30 mm.

In order to prevent the flush water from splashing outside the bowl portion beyond the rim inside wall upper sloped surface more effectively, it is preferable that the ratio of the height of the rim inside wall upper sloped surface to the height of the rim inside surface is smaller in the section in a vertical plane at an area on a downstream side with respect to a flush water flow from the spout portion (where the flush water flow has a relatively high speed) than in the section in a vertical plane at any other area.

Furthermore, taking into account the centrifugal force, in order to prevent the flush water from splashing outside the bowl portion beyond the rim inside wall upper sloped surface more effectively, it is preferable that the ratio of the height of the rim inside wall upper sloped surface to the height of the rim inside surface is smaller in the section in a vertical plane at an area where a curvature radius of the rim portion in a plan view reduces with respect to a direction of a flush water flow from the spout portion than in the section in a vertical plane at any other area.

In addition, it is preferable that the ratio of the height of the rim inside wall upper sloped surface to the height of the rim inside surface is smaller in a foremost area than in any other rear area. This feature is effective for preventing the discharged urine from rising up along the rim inside wall upper sloped surface in the foremost area when the user sits down on a toilet seat.

Advantageous Effects of Invention

According to the above feature, since the rim inside wall upper sloped surface has a section in a vertical plane, the shape of the section being sloped from the upper edge of the rim inside surface to the upper edge of the rim inside wall portion, an improved visibility is achieved, i.e., the user can perceive that the top portion of the waste receiving surface widens outward, as well as an improved cleaning easiness is achieved. In addition, since the ratio between the height of the rim inside surface and the height of the rim inside wall upper sloped surface is within a range of 1:1 to 6:1 in a section in a vertical plane at any area other than a rear area, it is possible to prevent the flush water from splashing outside the bowl portion beyond the rim inside wall upper sloped surface by a centrifugal force. Furthermore, since the ratio between the height of the rim inside surface and the height of the rim inside wall upper sloped surface is within a range of 1:1 to 6:1, it is possible to effectively prevent the discharged urine from rising up along the rim inside wall upper sloped surface and splashing outside the bowl portion beyond the rim inside wall upper sloped surface.

DETAILED DESCRIPTION

With reference to the attached drawings, we explain a flush toilet according to embodiments of the invention.

Figure 1:
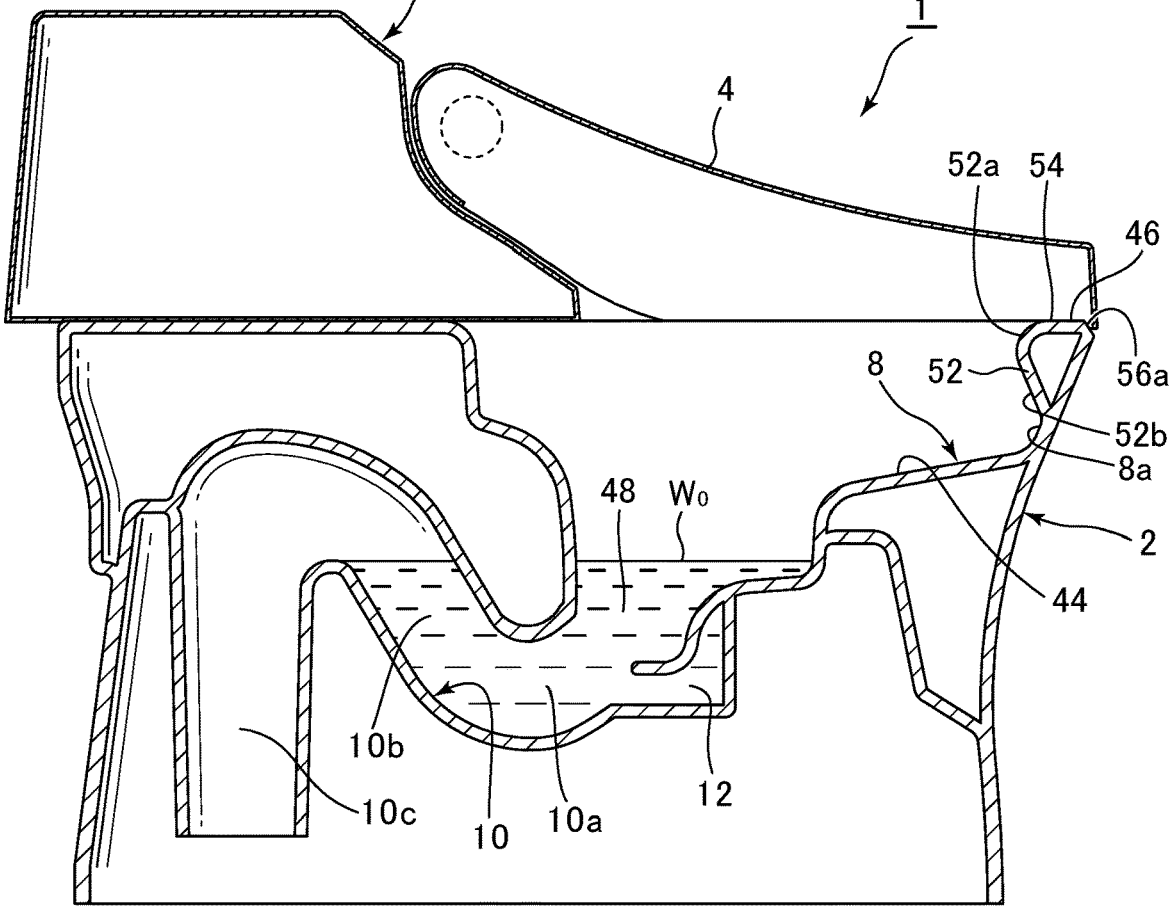
FIG. 1 is a partial cross section view showing a water supply apparatus and a cover of a flush toilet according to a first embodiment of the invention, seen from the side, and showing the interior of a toilet main unit along a center cross section.
Figure 2:
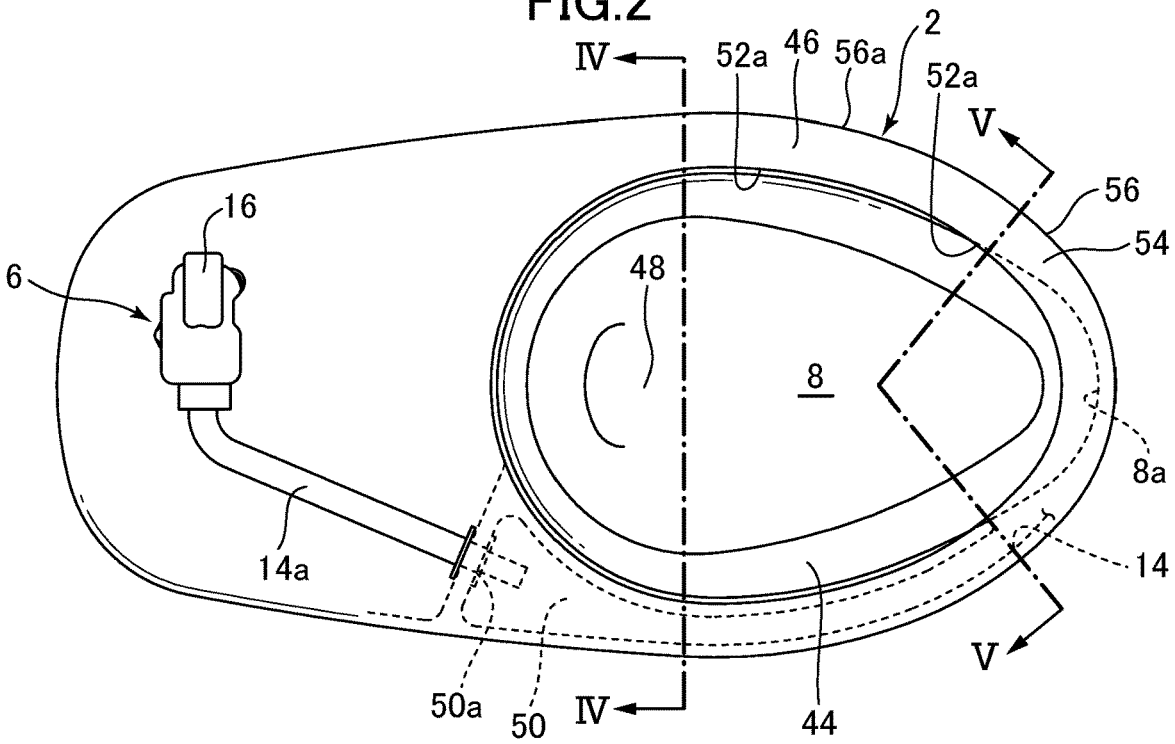
FIG. 2 is a plan view showing the flush toilet according to the first embodiment of the invention, in which the cover and a part of the water supply apparatus are removed.
Figure 3:
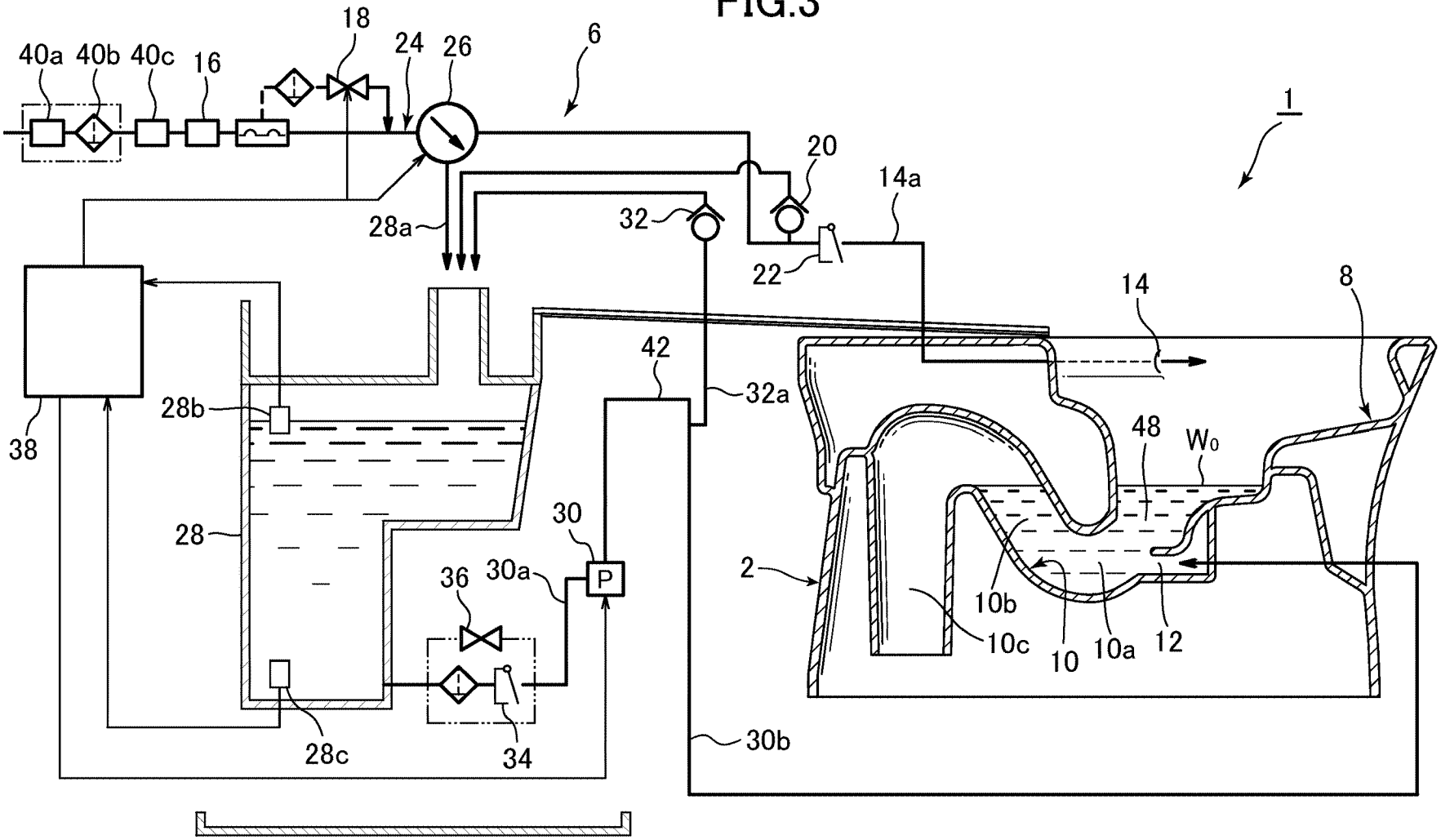
FIG. 3 is an overview schematic showing the flush toilet according to the first embodiment of the invention.

First, with reference to FIGS. 1 to 3, we explain the structure of a flush toilet according to a first embodiment of the invention. Herein, FIG. 1 is a partial cross section view showing a water supply apparatus and a cover of the flush toilet according to the first embodiment of the invention, seen from the side, and showing the interior of a toilet main unit along a center cross section. FIG. 2 is a plan view showing the flush toilet according to the first embodiment of the invention, in which the cover and a part of the water supply apparatus are removed. FIG. 3 is an overview schematic showing the flush toilet according to the first embodiment of the invention.

As shown in FIGS. 1 and 2, the flush toilet 1 according to the first embodiment of the invention includes: a toilet main unit 2; a toilet seat (not shown) disposed on the top surface of this toilet main unit 2; a cover 4 disposed to cover the toilet seat; and a water supply apparatus 6 disposed at a rear area of the toilet main unit 2.

The toilet main unit 2 is made of porcelain. The toilet main unit 2 is provided with: a bowl portion 8 for receiving waste; a discharge trap pipe 10 (discharge path) extending from a bottom portion of the bowl portion 8; a jet spout port 12 for performing a jet spouting; and a single rim spout port 14 (water spout portion) for performing a rim spouting.

The jet spout port 12 is formed at a bottom portion of the bowl portion 8. The jet spout port 12 is disposed essentially horizontally, oriented toward an inlet of the discharge trap conduit 10, and configured to spout flush water toward the discharge trap conduit 10.

The rim spout port 14 is formed to a front area of a left side top portion (as seen from the front side) of the bowl portion 8, and configured to spout the flush water forwardly along the edge of the bowl portion 8.

Note that in the present embodiment the jet spout port 12 is formed on the toilet main unit 2, but the invention is not limited to this manner. It is possible to form only a rim spout port without forming a jet spout port.

The discharge trap conduit 10 is made up of: an inlet portion 10*a*; a trap ascending pipe 10*b* rising from the inlet portion 10*a*; and a trap descending pipe 10*c* descending from this trap ascending pipe 10*b*.

The flush toilet 1 of the first embodiment is directly connected to a water utility, which supplies the flush water. The flush water is spouted from the rim spout port 14 with the aid of the utility's water supply pressure. With regard to jet spouting, as described below, the flush water having been stored in a storage tank 28, which is buried in the water supply apparatus 6, is pressurized by a pressurizing pump 30 to be spouted out from the jet spout port 12 at a high flow rate. That is to say, the flush toilet 1 in the present embodiment is a hybrid type of flush toilet which has a hybrid type of water supply apparatus (utility direct pressure type+tank supply type).

Note that the water supply apparatus 6 of the flush toilet 1 can also be applied to non-hybrid type water supply apparatuses. For example, a utility direct pressure type of flush toilet comprising only a utility direct pressure type of water supply apparatus in which flush water is supplied by the utility's water pressure, or another type of flush toilet in which flush water is supplied by using a flush valve system or a supplementary pump pressure, is also acceptable. Another type of water supply apparatus in which flush water is supplied to the toilet by using an accumulator or the like is also acceptable.

Herein, it should be noted that, if the rim spout water is supplied by using the utility water pressure (utility direct pressure), the flow rate of the rim spout water under the utility water pressure is likely to be a relatively high flow rate (relatively high instantaneous flow rate).

Next, with reference to FIG. 3, we explain details of the water supply apparatus 6 in the flush toilet 1 of the first embodiment.

As shown in FIG. 3, the water supply apparatus 6 is provided with: a constant flow rate valve (constant flow rate device) 16; an electromagnetic valve 18; a rim spout vacuum breaker 20 for preventing a reverse flow; and a rim spout flapper valve 22 for preventing a reverse flow. In addition, a switching valve 26 for switching between water supplying to the tank and rim spouting, a water storage tank 28, a pressurizing pump 30, a vacuum breaker 32 for jet spouting, a flapper valve 34 for jet spouting, and a water drain 36 are built into the water supply path 24. Also, a controller 38 for controlling the opening and closing operation of the electromagnetic valve 18, the switching operation of the switching valve 26, and the rpm and/or activation time of the pressurizing pump 30, is built into the water supply apparatus 6. By at least a part of such a constitution, the water supply apparatus 6 can function as a water supply apparatus for supplying the flush water to the toilet main unit 2.

The constant flow rate valve (the predetermined flow rate valve) 16 can control the inflowing flush water to a predetermined flow rate (instantaneous flow rate) or below by a stop cock 40*a*, a strainer 40*b*, and a splitter 40*c*. In the present embodiment, this constant flow rate valve 16 is arranged to control the flush water flow rate (instantaneous flow rate) between 10 liters/minute and 20 liters/minute, for example, and more preferably to between 12 liters/minute and 16 liters/minute. Thus, the constant flow rate valve 16 controls the flow rate of the flush water spouted from the rim spout port 14 to a predetermined instantaneous flow rate when the flush water flow rate has increased. Also, the constant flow rate valve 16 is capable of maintaining a predetermined instantaneous flow rate or greater when the flush water instantaneous flow rate drops. Therefore, when the flush water instantaneous flow rate fluctuates, the constant flow rate valve 16 can maintain the flow rate of the flush water to be supplied within a predetermined range, i.e., not less than a first predetermined instantaneous flow rate and not more than a second predetermined instantaneous flow rate.

The flush water which has passed through the constant flow rate valve 16 flows into the electromagnetic valve 18. The flush water which has passed through the electromagnetic valve 18 is supplied to the rim spout port 14 or the water storage tank 28 via the switching valve 26. The switching valve 26 is capable of supplying the flush water to both the rim side supply path 14*a* on the rim side and the tank side supply path 28*a* on the tank side at the same time, and of changing a supply proportion between the flush water to the rim side supply path 14*a* and the flush water to the tank side supply path 28*a*.

The electromagnetic valve 18 is opened and closed by a control signal from the controller 38, to cause the supplied flush water to flow into the switching valve 26, or to stop causing the same.

The switching valve 26 is switched by a control signal from the controller 38, to cause the flush water supplied through the electromagnetic valve 18 to be spouted from the rim spout port 14, or to flow into the water storage tank 28.

The water storage tank 28 is constituted to store the flush water to be spouted from the jet spout port 12 in near future. In the present embodiment, the water storage tank 28 has an internal capacity of approximately 2.5 liter.

In the water storage tank 28, a top end float switch 28*b* and a bottom end float switch 28*c* are disposed. Thereby, a water level inside the water storage tank 28 is detected. When the water level inside the water storage tank 28 reaches a predetermined stored water level, the top end float switch 28*b* is turned on, and the controller 38 detects it and causes the electromagnetic valve 18 to close. On the other hand, when the water level inside the water storage tank 28 drops to another predetermined stored water level, the bottom end float switch 28*c* is turned on, and the controller 38 detects it and stops the operation of the pressurizing pump 30.

The pressurizing pump 30 is configured to pressurize the flush water having been stored in the water storage tank 28, to cause the flush water to be spouted out from the jet spout port 12. The pressurizing pump 30 is connected to a flush water conduit 30*a*, which extends from a lower portion of the water storage tank 28, so that the pressurizing pump 30 pressurizes the flush water having been stored in the water storage tank 28.

In the present embodiment, the pressurizing pump 30 is configured to pressurize the flush water in the water storage tank 28 and cause the same to be spouted from the jet spout port 12 at a maximum flow rate of 120 liters/minute.

Also, a flapper valve for jet spouting 34, which may be a check valve, and a water drain 36 are provided midway along the flush water conduit 30*a*.

On the other hand, an outflow port of the pressurizing pump 30 is connected to the jet spout port 12 at the bottom portion of the bowl portion 8 through another flush water conduit 30*b*.

The vacuum breaker for jet spouting 32 is connected to a branch conduit 32*a*, which branches from a portion on the downstream side of the pressurizing pump 30 and a flush water conduit apex portion 42. The vacuum breaker for jet spouting 32 prevents a reverse flow of water pooled inside the bowl portion 8 toward the inside of the water storage tank 28, and partitions therebetween.

The controller 38 sequentially activates the electromagnetic valve 18, the switching valve 26 and the pressurizing pump 30 via the user's manipulation of a toilet flush switch (not shown), and sequentially starts the spouting from the rim spout port 14 and the spouting from the jet spout port 12, so as to flush the bowl portion 8. In addition, after completion of the flushing, the controller 38 releases the electromagnetic valve 18, switches the switching valve 26 to the water storage tank 28 side, and replenishes the flush water to the water storage tank 28. When the water level inside the water storage tank 28 rises and thus the top end float switch 28*b* detects the specified stored water amount, the controller 38 causes the electromagnetic valve 18 to close and stops the supply of water.

Furthermore, we explain each part of the toilet main unit 2.

The bowl portion 8 comprises a waste receiving surface 44 formed in a bowl shape, and a rim portion 46 formed on the top outer side of an entire perimeter of the bowl portion 8. The rim portion 46 forms a top portion edge of the toilet main unit 2. Also, a pooled water portion 48 is formed at a bottom of the bowl portion 8. In the pooled water portion 48, the flush water is accumulated up to a predetermined amount after each flushing, so that a pooled water surface W0 is formed. The above-described inlet portion 10*a* of the discharge trap conduit 10 is opened at a bottom of the pooled water portion 48. A bottom end of the trap descending pipe 10*c* of the discharge trap conduit 10 is connected to a discharge pipe (not shown) under the floor through a discharge socket (not shown).

A water feeding channel 50 extends forward from an inlet portion 50*a* that is connected to the rim side supply path 14*a* extending from the water supply apparatus 6. The water feeding channel 50 communicates in a forward orientation with the rim spout port 14 located on the left side in a front side region of the bowl portion 8, which is the front side relative to a center line extending in the left-right direction, equally dividing in two the bowl portion 8 in the front-to-back direction. The rim spout port 14 spouts the flush water forward from the front region of the bowl portion 8, forming a flow toward the front end of the bowl portion 8, and also forming a flow which reverses from the front end 8*a* of the bowl portion 8 toward the rear side.

The flush water spouted from the rim spout port 14 circulates in the front direction of the toilet, from the rim spout port 14, onto the surface between the rim portion 46 and the waste receiving surface 44, and onto an inside surface 52*b* of the rim portion 46. A falling flow is formed so that the circulating flush water flows down as it circulates from the inside surface 52*b* of the rim portion 46 in the direction of the pooled water portion 48 on the waste receiving surface 44.

Next, with reference to FIGS. 1 to 6, we explain details of the above-described rim portion 46.

Figure 4:
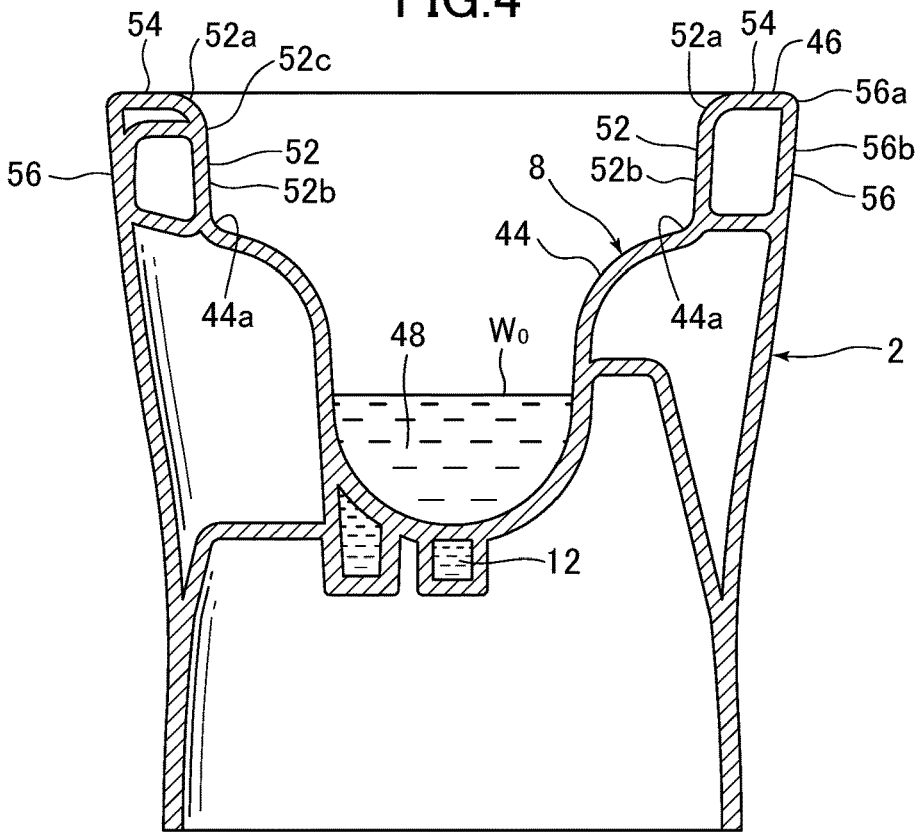
FIG. 4 is a cross section view taken along line IV-IV of FIG. 2.
Figure 5:
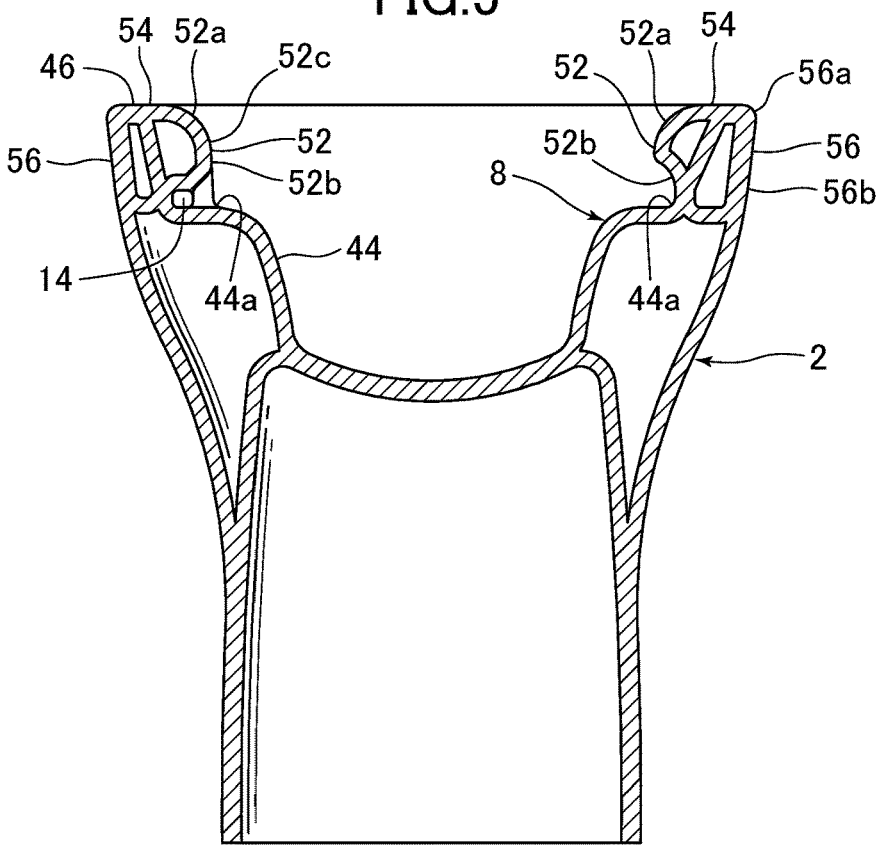
FIG. 5 is a cross section view taken along line V-V of FIG. 2.
Figure 6:
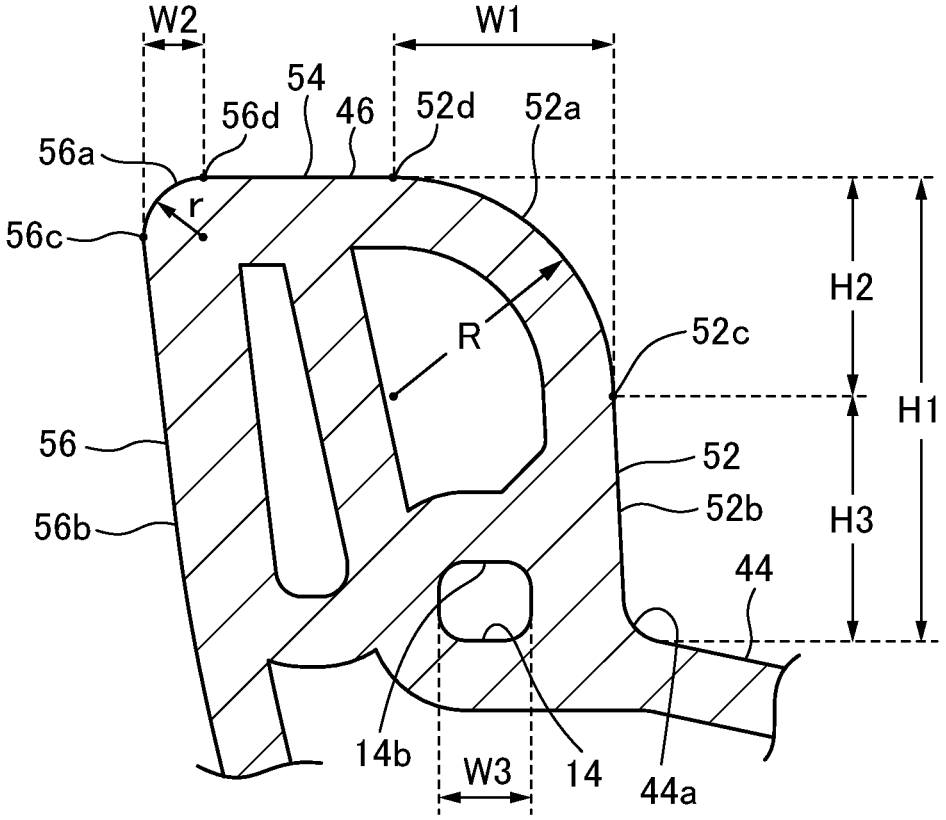
FIG. 6 is an expanded cross section view showing a rim portion in a vicinity of a rim spout port in the flush toilet according to the first embodiment of the invention.

FIG. 4 is a cross section view taken along line IV-IV of FIG. 2. FIG. 5 is a cross section view taken along line V-V of FIG. 2. FIG. 6 is an expanded cross section view showing a rim portion in a vicinity of a rim spout port in the flush toilet according to the first embodiment of the invention.

The rim portion 46 comprises: a rim inside wall portion 52 which forms an inside perimeter surface of the rim portion 46 and is formed in a standing wall shape rising from a top end 44*a* of the waste receiving surface 44 to an apex portion of the toilet main unit 2, a rim upper surface portion 54 which forms a top surface of this rim portion 46, and a rim outside wall portion 56 which forms an outside perimeter surface of the rim portion 46 and is formed in a standing wall shape rising along the outside surface of the toilet main unit 2 up to the rim upper surface portion 54.

The rim inside wall portion 52 has a rim inside wall upper sloped surface 52*a*, which is located at an upper area of the rim inside wall portion 52 and has a downwardly sloped shape on the inner side thereof, and a rim inside surface 52*b* having sections in many vertical planes, the shape of each section being linear (straight) substantially in the vertical direction up to the rim inside upper sloped surface 52*a* (the shape of other vertical sections may be inwardly concave up to the rim inside upper sloped surface 52*a*: see the right side of FIG. 5).

In other words, the rim inside wall portion 52 has: a rim inside surface 52*b* located at a lower area of the rim inside wall portion 52 and having a section in a vertical plane, the shape of the section being linear or inwardly concave; and a rim inside wall upper sloped surface 52*a* having a section in a vertical plane, the shape of the section being sloped from an upper edge of the rim inside surface 52*b* to an upper edge of the rim inside wall portion 52 (to the rim upper surface portion 54).

As shown in FIG. 2 etc., the rim inside wall portion 52 is formed over an entire perimeter on the inside of the rim portion 46. In the present embodiment, the inside surface 52*b* is formed to rise essentially vertically in the majority of regions.

In addition, in the present embodiment, in a part of the front-side region from the rim spout port 14 on the bowl portion 8 out of the rim inside wall portion 52, the flow speed of the flush water spouted from the rim spout port 14 is relatively fast. Thus, the top portion of the inside surface 52*b* and the rim inside wall upper sloped surface 52*a* are formed in a shape which overhangs toward the inside of the bowl portion 8 (see FIGS. 1 and 2). Except for the front-side region from the rim spout port 14 on the bowl portion 8, the flow speed of the flush water spouted from the rim spout port 14 is relatively slow. Thus, the top portion of the inside surface 52*b* and the rim inside wall upper sloped surface 52*a* are not formed in the shape which overhangs toward the inside of the bowl portion 8.

The height H1 of the rim inside wall portion 52 (see FIG. 6) is determined within a relatively limited range from the top end 44*a* of the waste receiving surface 44 to the apex of the toilet main unit 2 (the rim upper surface portion 54). The top end 44*a* of the waste receiving surface 44 is positioned in relation to the height of the discharge pipe. The height of the apex of the toilet main unit 2 is positioned in relation to the height of the toilet main unit 2. That is to say, the total height of the rim inside wall portion 52 is not freely changed, but adjusted within the relatively limited range.

According to knowledge obtained by the inventors, in order to constrain the flush water from splashing outside the bowl portion under centrifugal force along the rim inside wall upper sloped surface, it is preferable that a ratio between the height H3 of the rim inside surface 52*b* and the height H2 of the rim inside wall upper sloped surface 52*a* is within a range of 1:1 to 6:1, more preferably 1:1 to 4:1, in a section in a vertical plane at any area other than a rear area.

In other words, it is preferable that the rim inside wall upper sloped surface 52*a* is formed over a height H2 within a range of 20% to 50% of a height H1 from an upper end to a lower end of a predetermined area of the rim inside wall portion 52, as well as it is preferable that the rim inside surface 52*b* is formed over a height H3 within a range of 50% to 80% of the height H1 from the upper end to the lower end of the predetermined area of the rim inside wall portion 52.

The rim inside wall upper sloped surface 52*a* forms a sloped portion, which gradually connects the corner between the horizontally oriented rim upper surface portion 54 and the vertically oriented inside surface 52*b*. The rim inside wall upper sloped surface 52*a* of the present embodiment forms an arc shape projecting toward the center top of the bowl portion 8. That is to say, the rim inside wall upper sloped surface 52*a* of the present embodiment forms an arc shape connecting the rim upper surface portion 54 and the inside surface 52*b* in each vertical section.

The rim inside wall upper sloped surface 52*a* is formed so that its outside top end 52*d* is at the height position of the rim upper surface portion 54, and the inside of the rim inside wall upper sloped surface 52*a* slopes downward, while the top of the rim inside wall upper sloped surface 52*a* widens outward more than the bottom end 52*c* thereof. The rim inside wall upper sloped surface 52*a* may also be formed with a surface shape bent to encircle a curve as a whole while including a relatively flat surface for a part between the rim upper surface portion 54 and the inside surface 52*b*.

The sloped portion gradually connecting the horizontally oriented rim upper surface portions 54 on the rim inside wall top portion sloped surfaces 52*a* with the vertically oriented inside surfaces 52*b* may also be formed by a beveled shape, diagonally cutting off the corner. That is to say, the area between the rim upper surface portion 54 and the rim inside wall portion 52 may be formed of a flat surface at a predetermined angle.

For example, in a vertical cross section of the rim portion 46, preferably, the beveled surface may be a flat surface at an angle within a range of 20° to 70° relative to the plumb line passing through the bottom end 52*c* of the rim inside wall upper sloped surface 52*a*. More preferably, the beveled surface may be a flat surface at an angle within a range of 35° to 55° thereto. For example, the beveled surface may be a flat surface at 45 degree relative to the plumb line passing through the bottom end 52*c* thereof.

The rim inside wall upper sloped surface 52*a* is formed in such an arc shape that the slope of a tangent to its surface changes continuously according to its position. Therefore when the user places his (or her) hand to follow (fit) the rim inside wall upper sloped surface 52*a*, the occurrence of a space between his hand and the rim inside wall upper sloped surface 52*a* can be constrained, and his hand can be naturally placed to follow the entire curved surface. The rim inside wall upper sloped surface 52*a* may also be formed by a curved surface of another shape that can match or fit the curve of the human hand.

In the present specification, the "hand" of the above-described user placed to conform to the rim inside wall upper sloped surface 52*a* means not only the hand as a whole, but also the palm only or the finger(s) only. In addition, fitting of the user's "hand" to the rim inside wall upper sloped surface 52*a* includes cases of fitting the "hand" to the rim inside wall upper sloped surface 52*a* through a cleaning cloth or paper such as a piece of toilet paper for cleaning the toilet, etc. Also, fitting of the user's "hand" to the rim inside wall upper sloped surface 52*a* includes cases in which the user fits his hand to the rim inside wall upper sloped surface 52*a* through a cleaning cloth or the like with gloves or the like on the user's hand.

Viewed from the top plan view, a waste receiving surface 44 forming a descending curved surface toward the middle is disposed at the left-right center of the toilet main unit 2 (in the transverse direction when the toilet main unit 2 is seen from the front). The rim inside wall upper sloped surface 52*a*, the inside of which similarly forms a descending curved surface, is disposed on the outside of the waste receiving surface 44. Therefore when seen from the top plan view, the rim inside wall upper sloped surface 52*a* with a gradually (gently) inwardly descending curved surface is connected to the outside perimeter of the waste receiving surface 44. Thereby, the user can have an impression of forming a continuous outwardly spreading curved surface. I.e., the user can receive the impression that the waste receiving surface 44 is still further widened outward by the area of the rim inside wall upper sloped surface 52*a*. For example, in cases in which a male user urinates standing in front of the toilet main unit 2, conveying to the user the impression that the waste receiving surface 44 is wide constrains his worry that his urine might miss the waste receiving surface 44, which enables the user to urinate with ease. Moreover, even in cases where a user urinates sitting on the toilet seat (not shown) of the toilet main unit 2 conveying to the user the impression that the waste receiving surface 44 is wide before the toilet seat (not shown) is lowered constrains his or her worry that his or her urine might miss the waste receiving surface 44, which enables the user to urinate with ease.

As shown in FIG. 6, the bottom end 52*c* of the rim inside wall upper sloped surface 52*a* is placed above the rim spout port 14. More particularly, the bottom end 52*c* of the rim inside wall upper sloped surface 52*a* is placed above an apex 14*b* of the rim spout port 14. In other words, the inside surface 52*b* is formed up to a height above that of the apex 14*b* of the rim spout port 14. Therefore the rim spout port 14 is configured to spout the flush water so that the flush water contacts the inside surface 52*b* on the downstream side of the near vicinity of the rim spout port 14.

The rim inside wall upper sloped surface 52*a* is formed in a relatively gradual arc shape, and the left-right width thereof is formed to be relatively large. The width W1 in the horizontal direction (e.g., the direction from the inside toward the outside of the toilet main unit) between the top end 52*d* and the bottom end 52*c* of the rim inside wall upper sloped surface 52*a* is formed to be larger than the left-right width W3 of the opening of the rim spout port 14. The bottom end 52*c* of the rim inside wall upper sloped surface 52*a* is placed above the rim spout port 14, therefore the horizontal width W1 of the rim inside wall upper sloped surface 52*a* can be formed to be relatively large, and the vertical height H2 of the rim inside wall upper sloped surface 52*a* can be formed to be relatively large. Hence the rim inside wall upper sloped surface 52*a* can be formed to slope downward on the inside along a gradual arc shape with a large diameter.

The rim upper surface portion 54 forms a flat surface extending in the horizontal direction, and forms the peak surface of the toilet main unit 2. When seeking to clean the rim portion 46 of the toilet main unit 2, the user must clean the rim inside wall upper sloped surface 52*a* and the inside surface 52*b* with his palm, etc. disposed to follow the rim upper surface portion 54 horizontally, as well as with his fingers bent. The rim upper surface portion 54 is not limited to the horizontal surface, and may also be formed as a downward sloping surface or an upward sloping surface toward the bowl portion 8. Also, the rim upper surface portion 54 may be formed by a curved surface. Moreover, the rim upper surface portion 54 may also be formed as part of a sloped surface in which the top end 52*d* of the rim inside wall upper sloped surface 52*a* is extended to the outside. For example, if the rim upper surface portion 54 is formed as a part of the rim inside wall upper sloped surface 52*a*, the top end 52*d* of the rim inside wall upper sloped surface 52*a* and the top end of the rim outside wall upper sloped surface can be relatively smoothly connected, to form an upper surface of the rim portion 46.

The rim outside wall portion 56 comprises: a rim outside wall upper sloped surface (rim outside edge portion) 56*a* which connects the horizontally oriented rim upper surface portion 54 and the vertically oriented rim outside wall and forms an upper outside edge of the rim portion 46 (outside of the toilet main unit 2), and a rim outside wall 56*b* forming a vertical wall up to the rim outside wall upper sloped surface 56*a*.

The rim outside wall upper sloped surface 56*a* has rounded corners between the rim upper surface portion 54 and the rim outside wall, and the top end 56*d* on the inside thereof is at the height position of the rim upper surface portion 54, while the outside thereof forms a downward sloping edge portion. The rim outside wall upper sloped surface 56*a*, when seen in expanded view, forms an arc shape projecting outward and upward. That is to say, it forms an arc shape connecting the rim upper surface portion 54 and the rim outside wall 56*b*.

Seen in a vertical cross section, the rim outside wall upper sloped surface 56*a* is formed by an arc having a radius r of 5 mm to 8 mm. The rim inside wall upper sloped surface 52*a*, when seen in a vertical cross section, is formed by an arc having a radius R of 10 mm to 30 mm, more preferably 16 mm to 25 mm. The ratio of the radius r of the arc forming the rim outside wall upper sloped surface 56*a* to the radius R of the arc forming the rim inside wall upper sloped surface 52*a* is formed within a range of 1:2 to 1:5. The width W1 of the rim inside wall upper sloped surface 52*a* in the horizontal direction (e.g., the direction facing from the inside direction toward the outside direction of the toilet main unit) is formed to be larger than the width W2 in the horizontal direction (e.g., the direction facing from the inside direction to the outside direction of the toilet main unit) between the top end 56*d* and the bottom end 56*c* of the rim outside wall upper sloped surface 56*a*. The rim inside wall upper sloped surface 52*a* is formed by an arc with a radius of 10 mm to 30 mm, therefore when the user places his hand on the rim inside wall upper sloped surface 52*a*, the hand can be naturally placed along the rim inside wall upper sloped surface 52*a*, and thus an easily gripped shape (state) can be formed without producing relatively large spaces relative to the rim portion 46.

In the rim outside wall upper sloped surface 56*a*, the rounding of the surface between the rim upper surface portion 54 and the rim outside wall 56*b* may also change continuously. That is to say, in the rim outside wall upper sloped surface 56*a*, the curvature radius of the surface between the rim upper surface portion 54 and the rim outside wall 56*b* may also change continuously.

Also, in the rim inside wall upper sloped surface 52*a*, the sloped surface formed between the rim upper surface portion 54 and the inside surface 52*b* may be formed by a curved surface which continuously changes such that the sloped surface is rounded. That is to say, in the rim inside wall upper sloped surface 52*a*, the curvature radius of the surface between the rim upper surface portion 54 and the inside surface 52*b* may also change continuously.

Also, as described above, in at least a part of the total perimeter of the rim portion 46, the inside surface 52*b* and the rim inside wall upper sloped surface 52*a* are formed in an overhanging shape toward the inside, and thus the rim portion 46 is easily gripped to enable lifting up by an installer or manufacturer with his hands placed on the inside of the rim portion 46 of the overhanging shape. Therefore when an installer or manufacturer carries the toilet, the placement of his hands onto the rim portion 46 formed in the overhanging shape enables the load for the lifting-up to act more easily on the rim portion 46, with his fingertips locked on the underside of the rim inside wall upper sloped surface 52*a*, facilitating carrying of the toilet.

Figure 7:
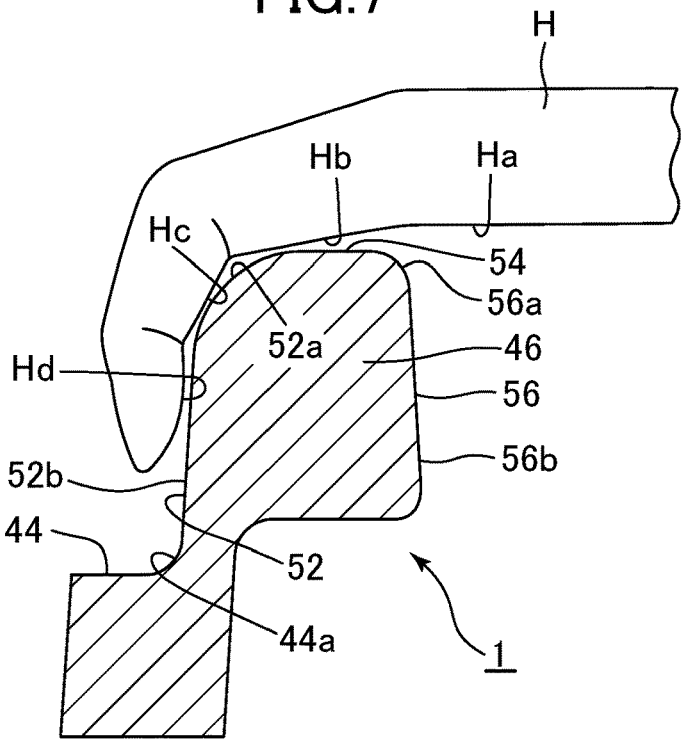
FIG. 7 is a schematic view showing a state in which a user's hand is placed to follow along a rim inside wall upper sloped surface of the rim portion in the flush toilet according to the first embodiment of the invention.
Figure 8:
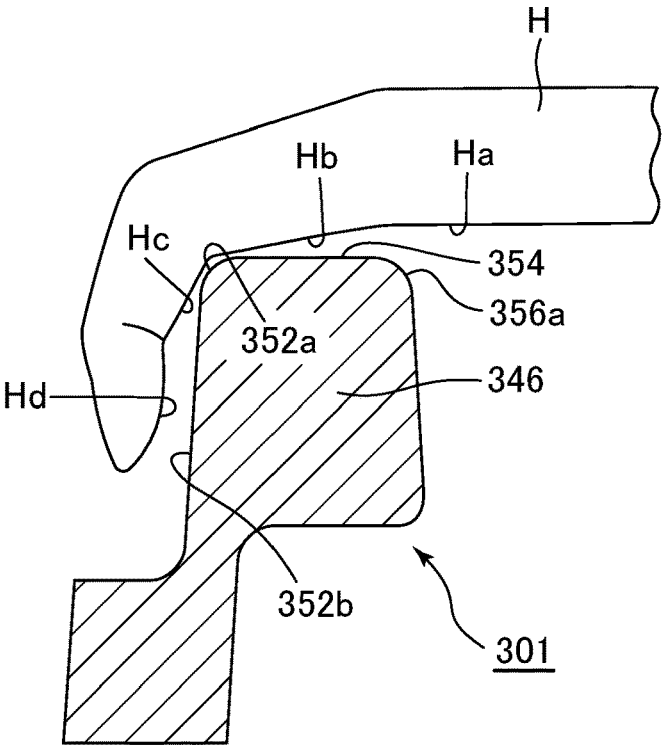
FIG. 8 is a schematic view showing a state in which a user's hand is placed to follow along a rim inside top edge portion in a conventional flush toilet.

Next, referring to FIGS. 7 and 8, we explain details of the above-described state, in which a user seeks to clean the rim portion 46.

FIG. 7 is a schematic view showing a state in which the user's hand is placed to follow along the rim inside wall upper sloped surface of the rim portion in the flush toilet according to the first embodiment of the invention. FIG. 8 is a schematic view showing a state in which the user's hand is placed to follow along a rim inside top edge portion in a conventional flush toilet. The user's hand and fingers is denoted in this explanation by an H.

In the present embodiment, when the user seeks to clean the rim portion 46, the user cleans the rim upper surface portion 54 with his hand and fingers H positioned so that his palm Ha and/or finger parts on the palm side Hb contact the rim upper surface portion 54, while cleaning the inside surface 52*b* with his hand and fingers H positioned so that his finger parts on the fingertip side Hd. The rim upper surface portion 54 forms approximately a horizontal plane, and the inside surface 52*b* forms approximately a vertical wall surface, therefore the user bends his finger joints to clean the inside surface 52*b* side. The rim inside wall upper sloped surface 52*a* forms a relatively large radius arc, so the finger parts (e.g., Hc, Hd) may be bent gradually, and the bent finger parts (e.g., Hc) may be positioned to follow the arc of the rim inside wall upper sloped surface 52*a*. Therefore the user can efficiently clean the rim upper surface portion 54, the rim inside wall upper sloped surface 52*a*, and the inside surface 52*b* at the same time, with the finger parts on the fingertip side Hd with respect to the finger joints in contact with the rim upper surface portion 54, with the second finger-joint part Hc in contact with the rim inside wall upper sloped surface 52*a*, and with the fingertip part Hd in contact with the inside surface 52*b*. Furthermore, the rim upper surface portion 54, the rim inside wall upper sloped surface 52*a* and the inside surface 52*b* can be brought in contact with the above respective parts of the hand and fingers H, without the user excessively bending his hand and fingers H forcedly. Thus, the user can easily impart the necessary cleaning force to his hand and fingers H. Therefore the cleanability of the rim upper surface portion 54, the rim inside wall upper sloped surface 52*a*, and the inside surface 52*b* is improved.

This enables the prevention of instances in which not enough cleaning force can be made to act on the rim inside wall upper sloped surface 52*a*, leading to problems with cleaning the rim inside wall upper sloped surface 52*a* and requiring further cleaning work when a user seeks to clean the inside surface 52*b* from the rim upper surface portion 54 side beyond the rim inside wall upper sloped surface 52*a*.

In response to this, as shown in FIG. 8, in a conventional flush toilet 301, a conventional rim inside wall upper edge portion 352*a* is formed in a rim portion 346. In such a conventional flush toilet 301, when a user seeks to clean the rim portion 346, i.e., when the user seek to clean a rim upper surface portion 354 with his hand and fingers H positioned so that his palm Ha and/or finger parts on the palm side Hb contact the rim upper surface portion 354, since the rim inside wall upper edge portion 352*a* forms a connecting part (edge portion) consisting of a relatively small radius arc (an arc with essentially the same radius as the rim outside wall upper sloped surface 365*a*), the finger parts cannot be bent such that the second finger-joint parts Hc are positioned to fit the arc of the rim inside wall upper edge portion 352*a*. That is to say, the second finger-joint parts Hc of the user's hand H are separated from the rim inside wall upper edge portion 352*a*, and the fingertip parts Hd are also separated from the inside surface 352*b*.

In order to bring the fingertip parts Hd in contact with the inside surface 352*b* from the above state, it is necessary to slightly raise the palm Ha and palm-side finger parts Hb to as to separate them from the rim top surface portion 354.

In the conventional flush toilet 301, because of the limitation in the range of human finger joint mobility, even if hypothetically the hand is excessively bent so that the palm-side finger parts Hb are brought in contact with the rim top surface portion 354 and the second finger joint parts Hc are brought in contact with an upper portion of the rim inside wall upper edge portion 352*a*, the second finger-joint parts Hc cannot be brought in contact with a lower portion of the rim inside wall upper edge portion 352*a*, and also the fingertip parts Hd cannot be brought in contact with the inside surface 352*b*. Therefore some problems arise with cleaning the rim inside wall upper edge portion 352*a* and the inside surface 352*b*, which results in more cleaning work.

In addition, in the conventional flush toilet 301, because of the limitation in the range of human finger joint mobility, even if hypothetically the hand is excessively bent so that the palm-side finger parts Hb are brought in contact with the rim top surface portion 354 and the fingertip parts Hd are brought in contact with the inside surface 352*b*, the second finger-joint parts Hc cannot be brought in contact with the rim inside wall upper edge portion 352*a*. Therefore some problems arise with cleaning the rim inside wall upper edge portion 352*a*, which results in more cleaning work.

In addition, the rim top surface portion 354 and some other curved surfaces cannot be followed by the parts of the user's hand and fingers H at the same time, unless the user excessively bends his hand and fingers H. This means that it is difficult for the user to impose a force required for cleaning on the hand and fingers H. That is to say, some problems may arise with the cleanability of the rim top surface portion 354, the rim inside wall upper edge portion 352*a* and/or the inside surface 352*b*.

Once again we explain the flush toilet according to the present embodiment.

As described above, in the flush toilet according to the above-described embodiment of the invention, the rim inside wall portion 52 comprises the rim inside wall upper sloped surface 52*a* in which the inside of the upper region of the rim inside wall portion 52 slopes downward. Therefore when a user wipes off the rim portion 46, the user's own hand can be placed on the rim inside wall upper sloped surface 52*a* from the top surface of the rim portion 46 up to the inside surface 52*b* to follow the rounding of the rim inside wall upper sloped surface 52*a*, and thereby the rim upper surface portion 54, the rim inside wall upper sloped surface 52*a*, and the inside surface 52*b* can be efficiently cleaned. In addition, wiping and cleaning can be accomplished while applying a relatively uniform force to the rim inside wall upper sloped surface 52*a* and the inside surface 52*b* from the rim upper surface portion 54 of the rim portion 46. Therefore, the user can easily apply a relatively strong force to the entire rim portion to be wiped and cleaned, and thereby cleanability of the entire rim portion can be improved.

Also, the rim inside wall portion 52 comprises the rim inside wall upper sloped surface 52*a*, whereby the inside of the upper region of the rim inside wall portion 52 slopes downward. Therefore the rim inside wall upper sloped surface 52*a* formed on the upper and outer side of the waste receiving surface 44 can give the user the impression that the waste receiving surface 44 widens further outward, and the bowl portion 8 can be made to appear relatively larger than in the past, thereby imparting a feeling of ease so that the user can discharge urine more easily into the bowl portion 8 during use.

In addition, in a toilet 1 according to the above-described embodiment of the invention, since the rim inside wall upper sloped surface 52*a* has a section in a vertical plane, the shape of the section being sloped from the upper edge of the rim inside surface to the upper edge of the rim inside wall portion, an improved visibility is achieved, i.e., the user can perceive that the top portion of the waste receiving surface 44 widens outward, as well as an improved cleaning easiness is achieved. In addition, since the ratio of the height of the rim inside wall upper sloped surface 52*a* to the height of the rim inside surface 52*b* is within a range of 0.25 to 1.0 in a section in a vertical plane at any area other than a rear area, it is possible to prevent the flush water from splashing outside the bowl portion 8 beyond the rim inside wall upper sloped surface 52*a* by a centrifugal force. Furthermore, since the ratio of the height of the rim inside wall upper sloped surface 52*a* to the height of the rim inside surface 52*b* is within a range of 0.25 to 1.0, it is possible to effectively prevent the discharged urine from rising up along the rim inside wall upper sloped surface 52*a* and splashing outside the bowl portion 8 beyond the rim inside wall upper sloped surface 52*a*.

In addition, in a toilet 1 according to the above-described embodiment of the invention, the section in a vertical plane of the rim inside wall upper sloped surface 52*a* has an arc shape. Such a rim inside wall upper sloped surface 52*a* can be formed relatively simply. Such a rim inside wall upper sloped surface 52*a* is also convenient for the user to keep clean by wiping. In particular, when the user wipes off the rim portion 46, the user's own hand can be placed on the rim inside wall upper sloped surface 52*a* from the rim upper surface portion 54 of the rim portion 46 to the inside surface 52*b* to follow the arc shape of the rim inside wall upper sloped surface 52*a*, and thereby the rim upper surface portion 54, the rim inside wall upper sloped surface 52*a*, and the inside surface 52*b* can be efficiently cleaned. That is to say, cleanability can be improved.

Also, using a flush toilet 1 according to the above-described embodiment of the invention, the flush water spouted from the rim spout port 14 can circulate along a region below the bottom end 52*c* of the rim inside wall upper sloped surface 52*a*, therefore the flush water can be constrained from exceeding the rim inside wall upper sloped surface 52*a* and splashing outside the toilet. Because the flush water circulates in this manner along the region area below the bottom end 52*c* of the rim inside wall upper sloped surface 52*a*, the width and size, etc. of the rim inside wall upper sloped surface 52*a* can be formed to be relatively large. However, the present invention is not limited to such embodiments; for example, a similar effect can be obtained if the position of the bottom end 52*c* of the rim inside wall upper sloped surface 52*a* is higher than the maximum height reached by the flush water at the rim spout port 14. For example, if the height of the flush water spouted from the rim spout port 14 reaches only the height center of the rim spout port 14, the bottom end 52*c* of the rim inside wall upper sloped surface 52*a* can be located at a position higher than the height center of the rim spout port 14.

Also, using a flush toilet 1 according to the above-described embodiment of the invention, the radius of the arc forming the rim inside wall upper sloped surface 52*a* is formed to be a radius easily gripped by the curve in a user's hand. It is therefore easy for the user's own fingers to follow the arc shape forming the rim inside wall upper sloped surface 52*a* when the user is wiping the rim portion 46.

Also, in a flush toilet 1 according to the above-described embodiment of the invention, a constant flow rate unit configured to cause the flush water to be spouted at a predetermined constant flow rate from the rim spout port 14 may be relatively simply formed by the constant flow rate valve 16.

Figure 9A:
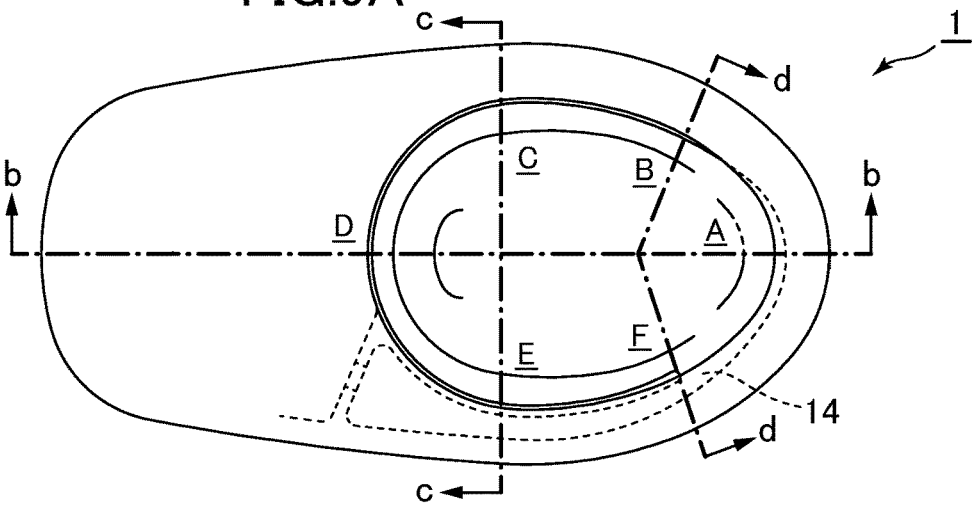
FIG. 9A is a plan view of the flush toilet according to the first embodiment of the invention, showing three types of sectional planes.
Figure 9B:
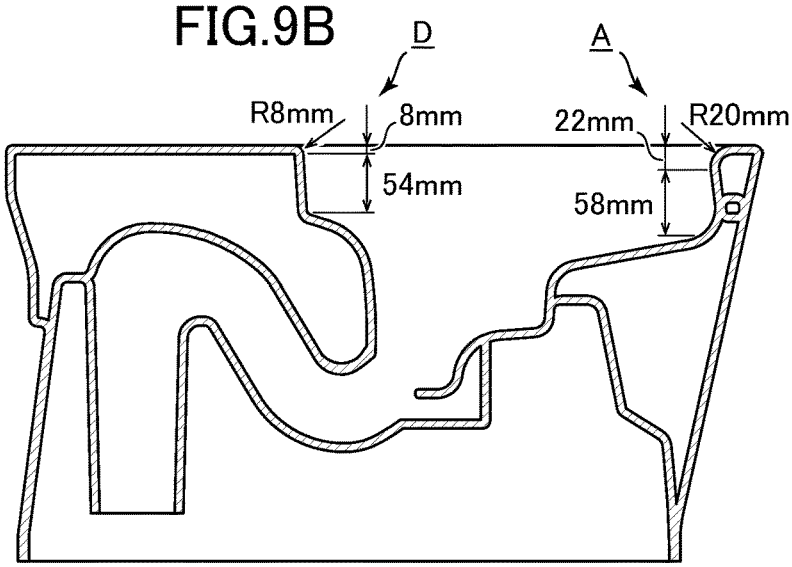
FIG. 9B is a cross section view taken along plane (line) b-b of FIG. 9A.
Figure 9C:
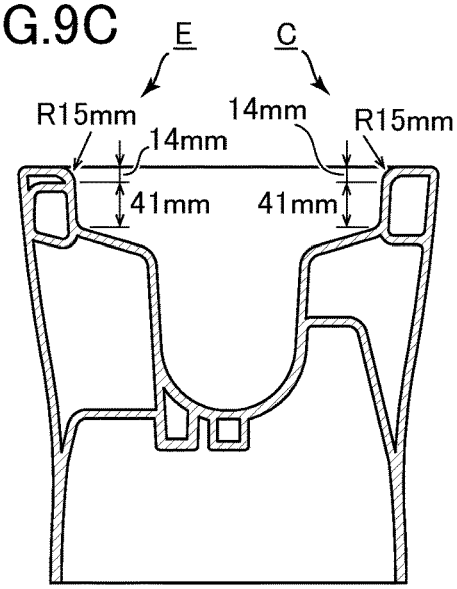
FIG. 9C is a cross section view taken along plane (line) c-c of FIG. 9A.
Figure 9D:
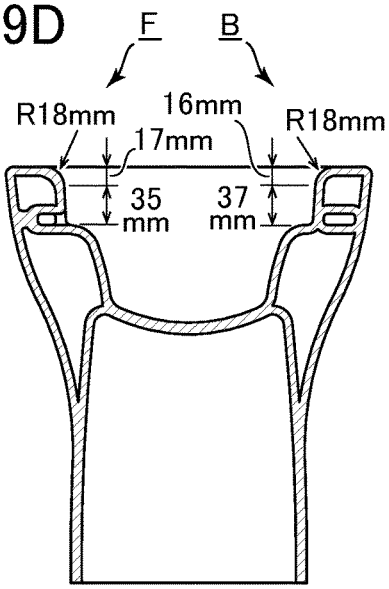
FIG. 9D is a cross section view taken along plane (line) d-d of FIG. 9A.

FIG. 9A is a plan view of the flush toilet according to the first embodiment of the invention, showing three types of sectional planes. FIG. 9B is a cross section view taken along plane (line) b-b of FIG. 9A. FIG. 9C is a cross section view taken along plane (line) c-c of FIG. 9A. FIG. 9D is a cross section view taken along plane (line) d-d of FIG. 9A.

In FIGS. 9A to 9D, the vertical section (A) corresponds to the foremost area on the downstream side of the rim spout port 14 (where the flush water has a higher speed); the vertical section (B) corresponds to an area opposite to the rim spout port 14 in the left-right direction; the vertical section (C) corresponds to an area where a curvature radius of the rim inside wall portion 52 in the plan view reduces with respect to the flow direction of the flush water; the vertical section (D) corresponds to the rearmost area; the vertical section (E) corresponds to an area opposite to the area (C) in the left-right direction; and the vertical section (F) corresponds to an area where the spout port 14 is located (opposite to the area (B) in the left-right direction).

In the section (A) (at the area (A)), the height of the rim inside surface 52*b* is 58 mm, the height of the rim inside wall upper sloped surface 52*a* is 22 mm, and thus the ratio therebetween is 0.37.

In the section (B) (at the area (B)), the height of the rim inside surface 52*b* is 37 mm, the height of the rim inside wall upper sloped surface 52*a* is 16 mm, and thus the ratio therebetween is 0.43.

In the section (C) (at the area (C)), the height of the rim inside surface 52*b* is 41 mm, the height of the rim inside wall upper sloped surface 52*a* is 14 mm, and thus the ratio therebetween is 0.34.

In the section (D) (at the area (D)), the height of the rim inside surface 52*b* is 54 mm, the height of the rim inside wall upper sloped surface 52*a* is 8 mm, and thus the ratio therebetween is 0.15.

In the section (E) (at the area (E)), the height of the rim inside surface 52*b* is 41 mm, the height of the rim inside wall upper sloped surface 52*a* is 14 mm, and thus the ratio therebetween is 0.34.

In the section (F) (at the area (F)), the height of the rim inside surface 52*b* is 35 mm, the height of the rim inside wall upper sloped surface 52*a* is 17 mm, and thus the ratio therebetween is 0.49.

As described above, according to the present embodiment, the ratio of the height of the rim inside wall upper sloped surface 52*a* to the height of the rim inside surface 52*b* is smaller in the section (A) where the flush water has the highest speed on the downstream side of the rim spout port 14, than in the sections (B) and (F) corresponding to the relatively front areas. Thereby, it is effectively prevented that the flush water splashes outside the bowl portion 8 beyond the rim inside wall upper sloped surface 52*a*.

In addition, the ratio of the height of the rim inside wall upper sloped surface 52*a* to the height of the rim inside surface 52*b* is smaller in the section (C) where the curvature radius of the rim portion 46 in the plan view reduces with respect to the flow direction of the flush water, than in the sections (A) and (B). This feature is also effective to prevent the flush water from splashing outside the bowl portion 8 beyond the rim inside wall upper sloped surface 52*a*, in light of the principle of the centrifugal force.

Figure 10A:
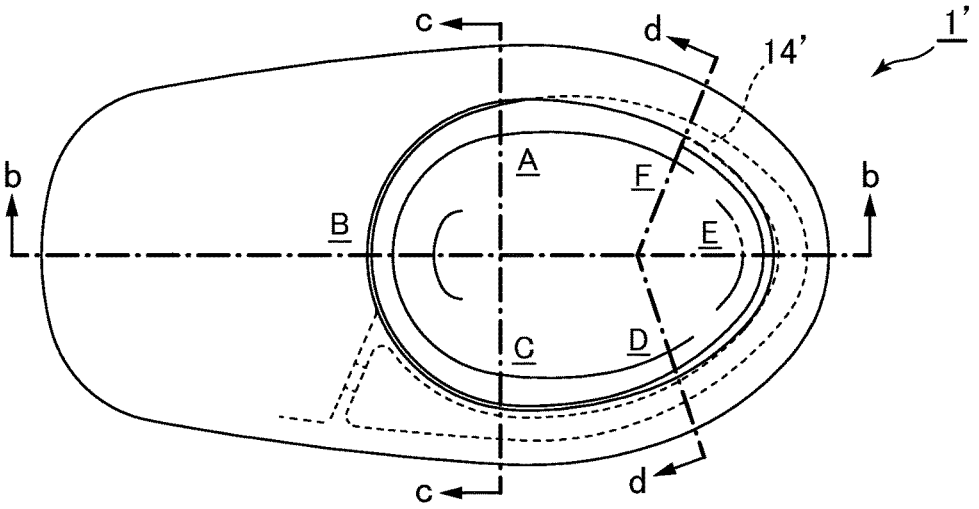
FIG. 10A is a plan view of a flush toilet according to a modification of the first embodiment of the invention, showing three types of sectional planes.
Figure 10B:
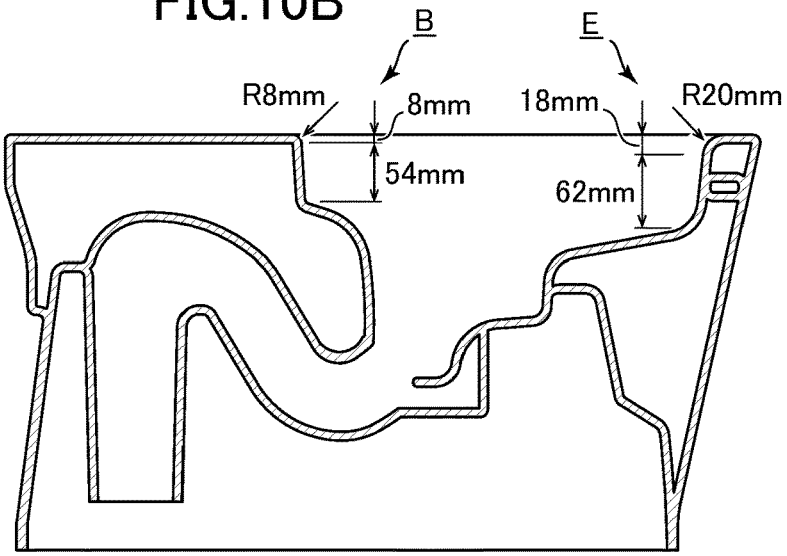
FIG. 10B is a cross section view taken along plane (line) b-b of FIG. 10A.
Figure 10C:
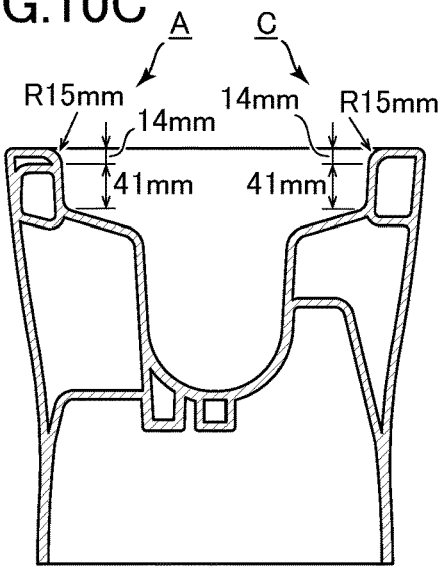
FIG. 10C is a cross section view taken along plane (line) c-c of FIG. 10A.
Figure 10D:
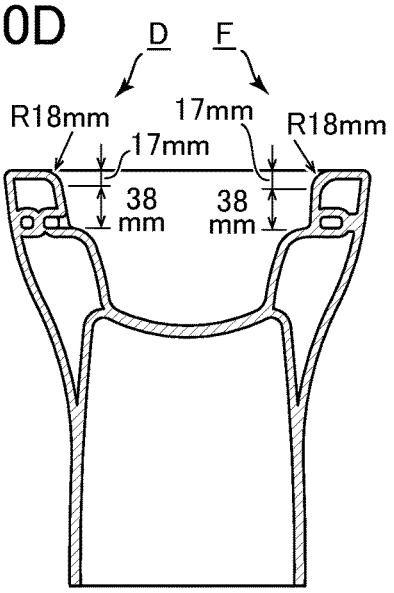
FIG. 10D is a cross section view taken along plane (line) d-d of FIG. 10A.

Next, FIG. 10A is a plan view of a flush toilet according to a modification of the first embodiment of the invention, showing three types of sectional planes. FIG. 10B is a cross section view taken along plane (line) b-b of FIG. 10A. FIG. 10C is a cross section view taken along plane (line) c-c of FIG. 10A. FIG. 10D is a cross section view taken along plane (line) d-d of FIG. 10A. In the modification shown in FIGS. 10A-10D, the rim spout port 14' is located at a right, upper and front area, and configured to spout the flush water rearward along the edge of the bowl portion 8.

In FIGS. 10A to 10D, the vertical section (A) corresponds to an area on the downstream side of the rim spout port 14' (where the flush water has the highest speed and where a curvature radius of the rim inside wall portion 52 in the plan view reduces with respect to the flow direction of the flush water); the vertical section (B) corresponds to the rearmost area; the vertical section (C) corresponds to an area opposite to the area (A) in the left-right direction; the vertical section (D) corresponds to an area opposite to the rim spout port 14' in the left-right direction; the vertical section (E) corresponds to the foremost area; and the vertical section (F) corresponds to an area where the spout port 14' is located (opposite to the area (D) in the left-right direction).

In the section (A) (at the area (A)), the height of the rim inside surface 52*b* is 41 mm, the height of the rim inside wall upper sloped surface 52*a* is 14 mm, and thus the ratio therebetween is 0.34.

In the section (B) (at the area (B)), the height of the rim inside surface 52*b* is 54 mm, the height of the rim inside wall upper sloped surface 52*a* is 8 mm, and thus the ratio therebetween is 0.15.

In the section (C) (at the area (C)), the height of the rim inside surface 52*b* is 41 mm, the height of the rim inside wall upper sloped surface 52*a* is 14 mm, and thus the ratio therebetween is 0.34.

In the section (D) (at the area (D)), the height of the rim inside surface 52*b* is 38 mm, the height of the rim inside wall upper sloped surface 52*a* is 17 mm, and thus the ratio therebetween is 0.45.

In the section (E) (at the area (E)), the height of the rim inside surface 52*b* is 62 mm, the height of the rim inside wall upper sloped surface 52*a* is 18 mm, and thus the ratio therebetween is 0.29.

In the section (F) (at the area (F)), the height of the rim inside surface 52*b* is 38 mm, the height of the rim inside wall upper sloped surface 52*a* is 17 mm, and thus the ratio therebetween is 0.45.

As described above, according to the present modification, the ratio of the height of the rim inside wall upper sloped surface 52*a* to the height of the rim inside surface 52*b* is smaller in the section (A) where the flush water has the highest speed on the downstream side of the rim spout port 14' and where the curvature radius of the rim inside wall portion 52 in the plan view reduces with respect to the flow direction of the flush water, than in the sections (D) and (F). Thereby, it is effectively prevented that the flush water splashes outside the bowl portion 8 beyond the rim inside wall upper sloped surface 52*a*.

Figure 11:
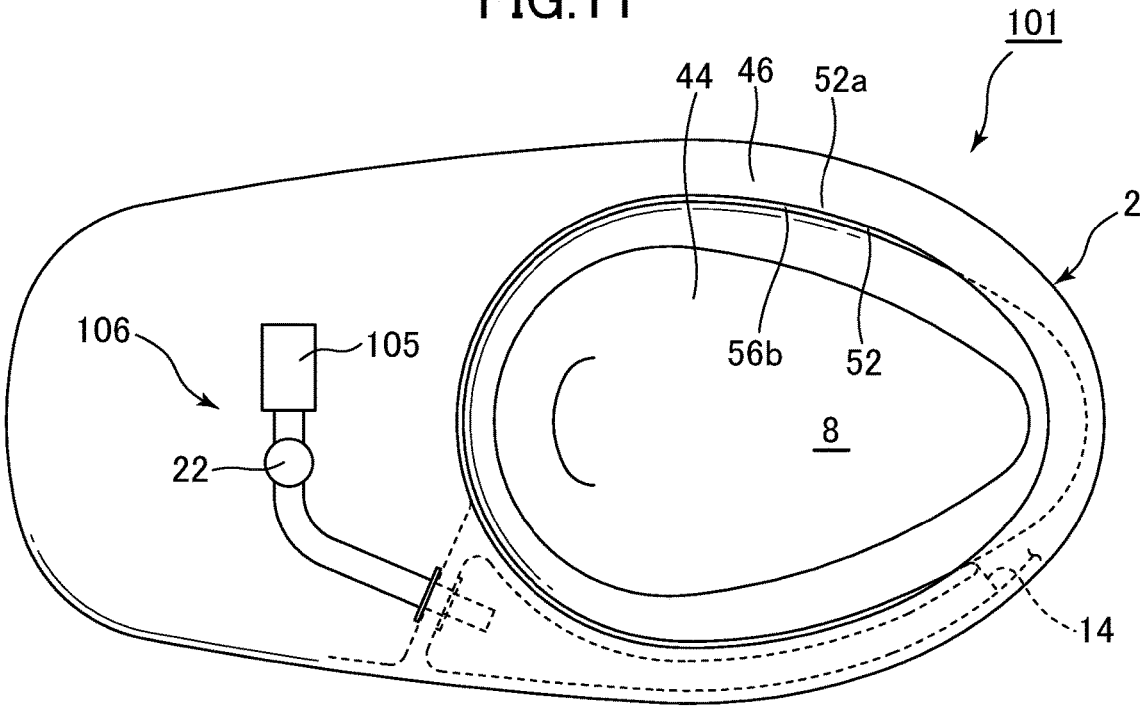
FIG. 11 is a plan view showing a flush toilet according to a second embodiment of the invention, in which a cover and a part of a water supply apparatus are removed.

Next, with reference to FIG. 11, a flush toilet according to a second embodiment of the invention is explained. In the hybrid water supply apparatus 6 according to the first embodiment of the invention, the rim spout water is supplied by using the water pressure of the utility water. In contrast, in the hybrid water supply apparatus 106 according to the second embodiment of the invention, the rim spout water is supplied by using the water pressure pressurized by a water supply pressurizing pump 105 from a water source.

FIG. 11 is a plan view showing the flush toilet according to the second embodiment of the invention, in which a cover and a part of the water supply apparatus are removed. The flush toilet according to the second embodiment has almost the same structure as the flush toilet according to the above-described first embodiment. We will explain those parts, etc. of the second embodiment which differ from the first embodiment.

As shown in FIG. 11, the flush toilet 101 according to the second embodiment comprises the hybrid water supply apparatus 106, which is disposed at a rear area of the toilet main unit 2. In the hybrid water supply apparatus 106 according to the second embodiment, the flush water flows from a water supply source such as a utility into a flush water tank (not shown) through the stop cock 40*a*, and the flush water is stored in the flush water tank. Subsequently, the flush water stored in the flush water tank is discharged (spouted) from the rim spout port 14 by a water pressure achieved by pressurizing (supplementing) the supply pressure of flush water in the flush water tank using the water supply pressurizing pump 105.

In the water supply apparatus 6 of the flush toilet 1 according to the first embodiment of the invention, the flush water instantaneous flow rate is constrained to a predetermined instantaneous flow rate or below by the constant flow rate valve 16. In contrast, in the water supply apparatus 106 of the flush toilet 101 according to the second embodiment of the invention, the flush water tank (not shown) and the water supply pressurizing pump 105 are provided in place of the constant flow rate valve 16, and the flush water instantaneous flow rate is constrained to a predetermined instantaneous flow rate or below by the water supply pressurizing pump 105.

The hybrid water supply apparatus 106 has: the stop cock 40*a*; the flush water tank (not shown) for storing the flush water supplied from the water source such as a utility or the like; the water supply pressurizing pump 105 capable of pressurizing the flush water from the flush water tank up to a water pressure within a predetermined range; and the reverse flow-preventing check valve (rim spouting flapper valve 22 or the like).

The flush water which has passed through the water supply pressurizing pump 105 is supplied to the rim spout port 14. The water supply pressurizing pump 105 can pressurize the flush water and feed it at a predetermined flow rate (instantaneous flow rate) or greater, and also can control the degree of pressurization so as to feed the flush water while controlling it to a predetermined flow rate (instantaneous flow rate) or below. In the present embodiment, the water supply pressurizing pump 105 is, for example, configured to control the flush water flow rate (instantaneous flow rate) to not less than 10 liters/minute and not more than 20 liters/minute (and more preferably not less than 12 liters/minute and not more than 16 liters/minute). Thus the water supply pressurizing pump 105 is able to control the flush water flow rate to a predetermined instantaneous flow rate or below, and is able to maintain the flush water flow rate at a predetermined instantaneous flow rate. Therefore, when the flush water instantaneous flow rate fluctuates, the water supply pressurizing pump 105 can maintain the flow rate of the flush water to be supplied within a range not less than a predetermined instantaneous flow rate and not more than another predetermined instantaneous flow rate.

In the same manner as in the flush toilet 1 according to the first embodiment, in the toilet 101 according to the second embodiment of the invention, the rim inside wall portion 52 comprises the rim inside wall upper sloped surface 52*a* wherein the inside of the upper region of the rim inside wall portion 52 slopes downward, so that the user visibility is improved so that the upper portion of the waste receiving surface 44 is perceived to widen outward, and the cleanability of the rim portion 46 is improved, and the rim inside wall upper sloped surface 52*a* is formed in which the inside of the upper region of the rim inside wall portion 52 upper region slopes downward, therefore the height of the inside surface 52*b* vertically extending straight up to the rim inside wall upper sloped surface 52*a* is formed to have a relatively low height.

Therefore, even if the height of the inside surface 52*b* is formed to be relatively low, the water supply pressurizing pump 105 of the water supply apparatus 106 is able to cause the flush water to be spouted at a predetermined constant flow rate from the rim spout port 14, the flush water caused to be spouted from the rim spout port 14 can be prevented from reaching a relatively high instantaneous flow rate, and the flush water can be constrained from traveling under a centrifugal force from the inside surface 52*b* formed at a relatively low height along the rim inside wall upper sloped surface 52*a* and splashing outside the bowl portion 8.

Also, using the flush toilet 101 according to the above-described second embodiment of the invention, a constant flow rate device for achieving a predetermined constant flow rate of the flush water spouted from the rim spout port 14 can be relatively easily formed by the water supply pressurizing pump 105.

Figure 12:
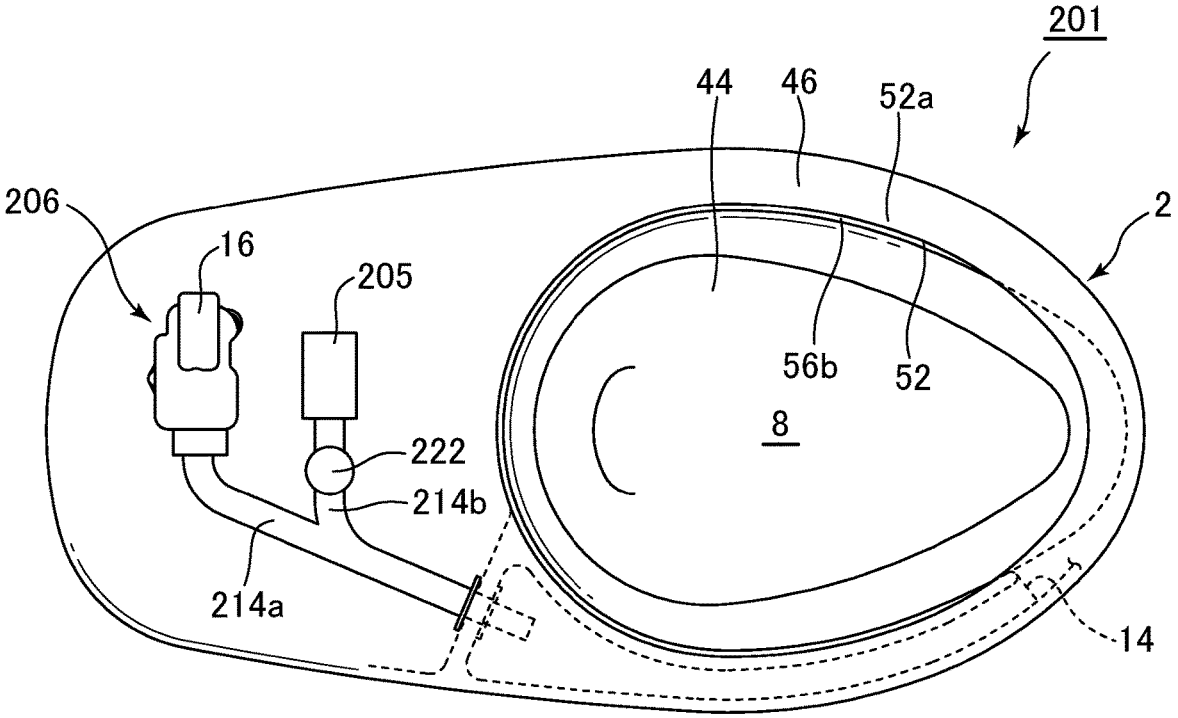
FIG. 12 is a plan view showing a flush toilet according to a third embodiment of the invention, in which a cover and a part of a water supply apparatus are removed.

Next, with reference to FIG. 12, a flush toilet according to a third embodiment of the invention is explained. In the hybrid water supply apparatus 6 according to the first embodiment of the invention, the rim spout water is supplied by using the water pressure of the utility water. In contrast, in the hybrid water supply apparatus 206 according to the third embodiment of the invention, in addition to such a first water supply system of the hybrid water supply apparatus 6 according to the first embodiment of the invention, a second water supply system is added in parallel for storing the flush water from a water source in a flush water tank (not shown), and subsequently supplying the flush water in the flush water tank using a supply pressure supplemented by a water supply pressurizing pump 205.

FIG. 12 is a plan view showing the flush toilet according to the third embodiment of the invention, in which a cover and a part of the water supply apparatus are removed. The flush toilet according to the third embodiment has almost the same structure as the flush toilets according to the above-described first and second embodiments. We will explain those parts, etc. of the third embodiment which differ from the first and second embodiments.

As shown in FIG. 12, the flush toilet 201 according to the third embodiment comprises the water supply apparatus 206, which is disposed at a rear area of the toilet main unit 2. In the water supply apparatus 206 according to the third embodiment, the flush water flowing in from a water supply source such as a utility passes through the stop cock 40*a*, and subsequently branches away. One branched flow path is connected to the first water supply system 214*a* in which the rim spout water is supplied to the rim spout port 14 through the constant flow rate valve 16 by using the utility water pressure, in the same way as in the first embodiment. The other branched flow path is connected to the second water supply system 214*b* in which the flush water is stored in a flush water tank (not shown) and subsequently the flush water stored in the flush water tank is discharged (spouted) from the rim spout port 14 by a water pressure achieved by pressurizing (supplementing) the supply pressure of flush water in the flush water tank using the water supply pressurizing pump 205.

In the first water supply system 214*a*, the water supply apparatus 206 has the constant flow rate valve 16 and the electromagnetic valve 18 for restraining the flow rate of the flush water supplied from the water source to a predetermined flow rate (instantaneous flow rate) or below.

In the second water supply system 214*b*, the water supply apparatus 206 has: the flush water tank for storing the flush water supplied from the water source such as a utility or the like; the water supply pressurizing pump 205 capable of pressurizing the flush water from the flush water tank up to a water pressure within a predetermined range; and the reverse flow-preventing check valve (rim spouting flapper valve 222 or the like).

The first water supply system 214*a* and the second water supply system 214*b* are formed in parallel, and are merged before reaching the rim spout port 14. Thus, in the water supply apparatus 206, a predetermined flow rate of the flush water can be rim spouted through either the first water supply system 214*a* or the second water supply system 214*b*.

The water supply pressurizing pump 205 can pressurize the flush water and feed it at a predetermined flow rate (instantaneous flow rate) or greater, and also can control the degree of pressurization so as to feed the flush water while controlling it to a predetermined flow rate (instantaneous flow rate) or below. In the present embodiment, the water supply pressurizing pump 205 is, for example, configured to control the flush water flow rate (instantaneous flow rate) to not more than 16 liters/minute. Thus the water supply pressurizing pump 205 is able to control the flush water flow rate to a predetermined instantaneous flow rate or below, and is able to maintain the flush water flow rate at a predetermined instantaneous flow rate. Therefore, when the flush water instantaneous flow rate fluctuates, the water supply pressurizing pump 205 can maintain the flow rate of the flush water to be supplied within a range not less than a predetermined instantaneous flow rate and not more than another predetermined instantaneous flow rate.

In the same manner as in the flush toilet 1 according to the first embodiment, in the toilet 201 according to the third embodiment of the invention, the rim inside wall portion 52 comprises the rim inside wall upper sloped surface 52*a* wherein the inside of the upper region of the rim inside wall portion 52 slopes downward, so that the user visibility is improved so that the upper portion of the waste receiving surface 44 is perceived to widen outward, and the cleanability of the rim portion 46 is improved, and the rim inside wall upper sloped surface 52*a* is formed in which the inside of the upper region of the rim inside wall portion 52 upper region slopes downward, therefore the height of the inside surface 52*b* vertically extending straight up to the rim inside wall upper sloped surface 52*a* is formed to have a relatively low height.

Therefore, even if the height of the inside surface 52*b* is formed to be relatively low, the constant flow rate valve 16 is able to maintain a constant instantaneous flow rate of the flush water spouted from the rim spout port 14, or the water supply pressurizing pump 205 of the water supply apparatus 206 is able to cause the flush water to be spouted at a predetermined constant flow rate from the rim spout port 14, the flush water caused to be spouted from the rim spout port 14 can be prevented from reaching a relatively high instantaneous flow rate, and the flush water can be constrained from traveling under a centrifugal force from the inside surface 52*b* formed at a relatively low height along the rim inside wall upper sloped surface 52*a* and splashing outside the bowl portion 8.

What is claimed is:

1. A flush toilet comprising:

a bowl portion including a bowl-shaped waste receiving surface having a perimeter with a front end section and a rim portion formed on a top edge of the bowl portion extending about the perimeter;

a spout portion provided in the bowl portion for generating a circulating current by spouting flush water to the bowl portion;

a water conduit for supplying flush water to the spout portion; and a discharge path connected at a bottom part of the bowl portion;

the rim inside wall portion forms in a section in at least a vertical plane at any area other than the front end section of the bowl wherein, a rim inside surface having a section in the vertical plane which extends straight upward from an upper end of the waste receiving surface, a rim inside wall upper sloped divergent surface having a section in the vertical plane which is outwardly sloped continuously from an upper edge of the rim inside surface to an upper edge of the rim inside wall portion, the rim inside wall upper sloped divergent surface is upward exposed to be seen from above and is located only outside the upper edge of the rim inside surface as seen from above, the section in a vertical plane of the rim inside wall upper sloped divergent surface has an arc shape which is exposed to be seen from above and is located only outside the upper edge of the rim inside surface as seen from above, and a ratio between the height of the rim inside surface and the height of the rim inside wall upper sloped divergent surface is within a range of 1:1 to 6:1, wherein, in the front end section of the bowl, the rim inside wall portion extends underneath an upper surface portion of the rim to retain the spouting flush water.

2. The flush toilet according to claim 1, wherein the arc shape of the section in a vertical plane of the rim inside wall upper sloped divergent surface has a curvature radius within a range of 10 mm to 30 mm.

3. The flush toilet according to claim 1, wherein the ratio of the height of the rim inside wall upper sloped divergent surface to the height of the rim inside surface is smaller in the section in a vertical plane at an area on a downstream side with respect to a flush water flow from the spout portion than in the section in a vertical plane at any other area.

4. The flush toilet according to claim 1, wherein the ratio of the height of the rim inside wall upper sloped divergent surface to the height of the rim inside surface is smaller in the section in a vertical plane at an area where a curvature radius of the rim portion in a plan view reduces with respect to a direction of a flush water flow from the spout portion.

5. The flush toilet according to claim 1, wherein the ratio of the height of the rim inside wall upper sloped divergent surface to the height of the rim inside surface is smaller in a foremost area than in any other than the front end section of the bowl.

* * * * *